US010272315B2

(12) United States Patent
Choi

(10) Patent No.: US 10,272,315 B2
(45) Date of Patent: Apr. 30, 2019

(54) GOLF PUTTING CORRECTION DEVICE

(71) Applicant: In Seok Choi, Seoul (KR)

(72) Inventor: In Seok Choi, Seoul (KR)

( * ) Notice: Subject to any disclaimer, the term of this patent is extended or adjusted under 35 U.S.C. 154(b) by 0 days.

(21) Appl. No.: 15/503,498

(22) PCT Filed: Aug. 3, 2015

(86) PCT No.: PCT/KR2015/008097

§ 371 (c)(1),
(2) Date: Jul. 11, 2017

(87) PCT Pub. No.: WO2016/024744

PCT Pub. Date: Feb. 18, 2016

(65) Prior Publication Data

US 2017/0312611 A1 Nov. 2, 2017

(30) Foreign Application Priority Data

Aug. 12, 2014 (KR) ..... 10-2014-0104579

(51) Int. Cl.
*A63B 63/00* (2006.01)
*A63B 69/36* (2006.01)
*A63B 71/06* (2006.01)

(52) U.S. Cl.
CPC ..... *A63B 69/3676* (2013.01); *A63B 69/3614* (2013.01); *A63B 69/3667* (2013.01);
(Continued)

(58) Field of Classification Search
CPC ..... A63B 69/3676
See application file for complete search history.

(56) References Cited

U.S. PATENT DOCUMENTS 2,592,713 A * 4/1952 Koch ..... A63B 63/00 473/182
4,249,739 A * 2/1981 Brandell ..... A63B 57/405 273/122 A (Continued)

FOREIGN PATENT DOCUMENTS

JP 2013094550 A 5/2013
KR 2020000006079 3/2000

(Continued)

OTHER PUBLICATIONS

Notification of Reason for Refusal issued in Korean Patent Application No. 10-2014-0104579 dated May 22, 2015 (9 pages).

(Continued)

*Primary Examiner* — Michael D Dennis
(74) *Attorney, Agent, or Firm* — RatnerPrestia

(57) ABSTRACT

Disclosed is a golf putting correction device. The golf putting correction device of the present disclosure includes: a body formed long in one direction so as to form a straight runway on which a golf ball rolls, and having a marked line formed along the center of the straight runway; and a guide formed above the straight runway, and having a through-hole formed to be parallel with the marked line, wherein a putting posture is corrected by a putting practice while observing the marked line through the through-hole. According to the present disclosure, it is possible to provide a golf putting correction device that can: correct an address posture such that eyes, a hole, and a golf ball are aligned on the same line; maintain the progressing direction of the golf ball to be constant even if it is repeatedly used; and provide a convenient transport and storage.

14 Claims, 8 Drawing Sheets

(52) U.S. Cl.
CPC . *A63B 2063/001* (2013.01); *A63B 2071/0694* (2013.01); *A63B 2210/50* (2013.01)

(56) References Cited

U.S. PATENT DOCUMENTS 4,828,267 A * 5/1989 Goodrich ..... A63B 67/02 473/160
5,409,231 A * 4/1995 Kueng ..... A63B 69/3676 473/157
5,776,007 A * 7/1998 Kendall ..... A63B 69/3676 248/176.1
6,746,339 B1 * 6/2004 Thibaudeau ..... A63B 69/3641 473/267
6,869,288 B1 * 3/2005 Faulkner ..... A63B 69/3667 434/252
7,744,482 B1 * 6/2010 Watson ..... A63B 24/0021 473/221
8,029,380 B1 * 10/2011 Johansen ..... A63B 69/3676 473/257
9,320,958 B2 4/2016 Yoo
2005/0079921 A1 4/2005 Brayton
2014/0179452 A1 * 6/2014 Chiono ..... A63B 69/3676 473/181

FOREIGN PATENT DOCUMENTS

KR 200410192 Y1 3/2006
KR 101286831 B1 7/2013

OTHER PUBLICATIONS

International Search Report issued in PCT/KR2015/008097 dated Nov. 9, 2015 (5 pages).
Written Opinion of the International Searching Authority issued in PCT/KR2015/008097 dated Nov. 9, 2015 (6 pages).

* cited by examiner

GOLF PUTTING CORRECTION DEVICE

CROSS REFERENCE TO RELATED APPLICATIONS

This application is the U.S. National Phase Application of PCT/KR2015/008097, filed Aug. 3, 2015, which claims priority to Korean Patent Application No. 10-2014-0104579, filed Aug. 12, 2014, the contents of such applications being incorporated by reference herein.

BACKGROUND OF THE INVENTION

Field of the Invention

The present disclosure relates to a golf putting correction device, and more specifically, relates to a golf putting correction device in which accurate address, alignment, and the position of a ball are naturally learned in the course of repeatedly practicing golf putting in order to thereby correct a putting posture.

Description of the Prior Art

A putter is the most common piece of equipment used to put a ball into the hole among the clubs that are used in the game of golf, and is a very important club of which the number of swings accounts for as many as nearly half the total swings in the whole game.

Since the main purpose of using the putter is to let the ball run with an aim at the hole, the travelling distance of the ball is not long, but it requires a higher accuracy, in comparison to other clubs. Direction and distance are the accuracy factors of the putting, and, among them, the trajectory and face of the putter influence the direction of the ball. In order to send a ball to a goal position, the trajectory of the putter is required to match the direction in which the ball is desired to move, and the face of the putter is required to be perpendicular to the direction in which the ball is desired to move when impacting. Various types of putting practice devices have been released in order to increase the putting accuracy.

In this regards, Korean Registered Utility Model No. 193305 discloses a golf putting practice device that includes: a putting mat that is attached to a base plate body; a hole cup that has an opening having a larger size than a golf ball in a part of the front surface, and of which the landing point is able to be moved; a guide sensor or an electronic device that is installed within the swing stroke of the putting to detect the deviation of the putter from the trajectory; and an alarm device that detects the deviation of the putter from the trajectory and gives an alarm.

According to Registered Utility Model No. 193305, since the golf putting practice device has a simple and lightweight structure, it is convenient to install, transport, and to use. In addition, the golf putting practice device enables a practice for a straight stroke that is required for the putting, and if the practicer fails to make a straight stroke, the guide sensor detects the same and gives an alarm in order to thereby correct the practicer's putting and putting habits for mastery.

However, the conventional putting practice devices including Registered Utility Model No. 193305 can correct only the stroke direction, but cannot correct the address posture. The correct address posture requires that eyes, a hole, and a golf ball are positioned on the same line. If the eyes, the hole, and the golf ball are not positioned on the same line, the putting may cause a push or pull phenomenon.

Conventionally, it is difficult to correct the same without another's help. Thus, a putting correction device for correcting the same is required to be developed.

Further, the conventional putting practice devices including Registered Utility Model No. 193305 cannot correct the leg interval and the positions of the feet and ball. According to the correct address posture, the correct leg interval and the correct alignment of the feet and ball lead to a correct stroke.

In addition, in the conventional putting practice devices including Registered Utility Model No. 193305, since the golf ball rolls freely toward the hole cup on the flat mat during the putting practice, creases and scratches are generated on the surface of the mat because of repeated use, a load of the human body, and deformation according to the storage of the same. Accordingly, the progressing direction of the golf ball may vary depending on the bending or scratches so that the putting practice may be performed in the state in which the address direction or the swing direction of the putter is not aligned.

In addition, since the conventional putting practice devices including Registered Utility Model No. 193305 are too big to be contained in the golf bag, it should be held and carried by one hand. Even if the putting practice device has a folded structure or a structure capable of being separated for the convenience of transport and storage, it is still not desirable to be used because its volume is big and a stretching and assembly operation is required for installation.

Furthermore, the conventional putting practice devices including Registered Utility Model No. 193305 are inconvenient because the balls that have rolled into the hole cup should be collected one by one during the practice. In addition, it is impossible to visually identify whether or not the golf ball is hit by the putter at a sweet spot.

SUMMARY OF THE INVENTION

The aspect of the present disclosure is to provide a golf putting correction device that may: correct an address posture such that eyes, a hole, and a golf ball are aligned on the same line; easily correct a leg interval and the positions of the feet and ball; maintain the progressing direction of the golf ball to be constant even if it is repeatedly used; provide a convenient transport and storage; automatically collect the golf balls when putting; and enable the visual confirmation on whether or not the golf ball is hit by the putter at a sweet spot.

The aspect above may be attained by a golf putting correction device, according to the present disclosure, that includes: a body formed long in one direction so as to form a straight runway on which a golf ball rolls, and having a marked line formed along the center of the straight runway; and a guide formed above the straight runway, and having a through-hole formed to be parallel with the marked line, wherein a putting posture may be corrected by a putting practice while observing the marked line through the through-hole.

The guide may include: a pair of supports coupled to the body to be slidable along the straight runway; and a cover portion configured to connect the pair of supports to each other, and having the through-hole formed therein, wherein a passage through which a golf ball passes is formed in the cover portion.

A tee insertion groove into which a golf tee is inserted in a straight line with the through-hole is formed in the cover portion.

A blow unit configured to return, to the other end, the golf ball that has rolled in during the putting practice may be installed at one end of the body.

The blow unit may be configured to include: a motor; and a blow wing configured to hit the golf ball by rotating while interworking with the motor.

A swing correction unit configured to include a goniometer and an angle indication rod coupled to the central axis of the goniometer to be rotatable may be installed on the side of the body.

A groove in which the golf ball rolls may be formed on the outer surface of the angle indication rod along the longitudinal direction in order to measure the speed of a green.

Tee insertion holes into which a golf tee is inserted may be formed on the body along the longitudinal direction of the straight runway.

The golf putting correction device may further include a golf practice stick configured to be: detachably coupled to the body; formed long in the X-direction; and formed to have a rectangular cross-section so as not to roll in the direction perpendicular to the X-direction even when it is placed on the inclined floor, wherein a protrusion configured to be inserted into the tee insertion hole and a coupling groove into which the protrusion is inserted may be formed at both ends of the golf practice stick, respectively.

A laser unit configured to emit laser in parallel with the straight runway may be installed in the body.

Gradations may be formed on the body along the longitudinal direction of the straight runway.

The body may be provided with: a pair of main rails formed on both sides of the marked line such that the golf ball rests and rolls thereon; and a pair of deviation-preventing rails formed to be spaced apart from a golf ball on both sides of the marked line and on the outside of the main rails.

The pair of main rails may be formed to be symmetrically inclined toward the center of the golf ball.

According to the present disclosure, it is possible to provide a golf putting correction device that includes: a body formed long in one direction so as to form a straight runway on which a golf ball rolls, and formed with a marked line along the center of the straight runway; and a guide formed above the straight runway, and having a through-hole formed to be parallel with the marked line, and that can: correct a putting posture by practicing putting while observing the marked line through the through-hole; correct an address posture such that eyes, a hole, and a golf ball are aligned on the same line; maintain the progressing direction of the golf ball to be constant even if it is repeatedly used; and provide a convenient transport and storage.

In addition, it is possible to provide a golf putting correction device that can easily correct a leg interval and the positions of the feet and ball by forming tee insertion holes into which a golf tee is inserted and gradations on the body along the longitudinal direction of the straight runway.

In addition, it is possible to provide a golf putting correction device that can automatically collect golf balls when putting by providing one end of the body with a blow unit that returns, to the other end of the body, the golf ball that has rolled in during the putting practice.

Furthermore, it is possible to provide a golf putting correction device that allows the practicer to visually identify whether or not the golf ball is hit by the putter at a sweet spot by means of the body that includes: a pair of main rails that are formed on both sides of the marked line such that the golf ball rests and rolls thereon; and a pair of deviation-preventing rails that are formed on both sides of the marked line and on the outside of the main rails so as to be spaced apart from the golf ball.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EXEMPLARY EMBODIMENTS

Hereinafter, exemplary embodiments of the present disclosure will be described in detail with reference to the accompanying drawings. In the description of the present disclosure, the description of the well-known function or structure will be omitted in order to clear the subject matter of the present disclosure.

A golf putting correction device of the present disclosure is configured to: correct an address posture such that eyes, a hole, and a golf ball are aligned on the same line; easily correct a leg interval and the positions of the feet and ball; maintain the progressing direction of the golf ball to be constant even if it is repeatedly used; provide a convenient transport and storage; automatically collect the golf balls when putting; and enable a visual confirmation on whether or not the golf ball is hit by the putter at a sweet spot.

Figure 1:
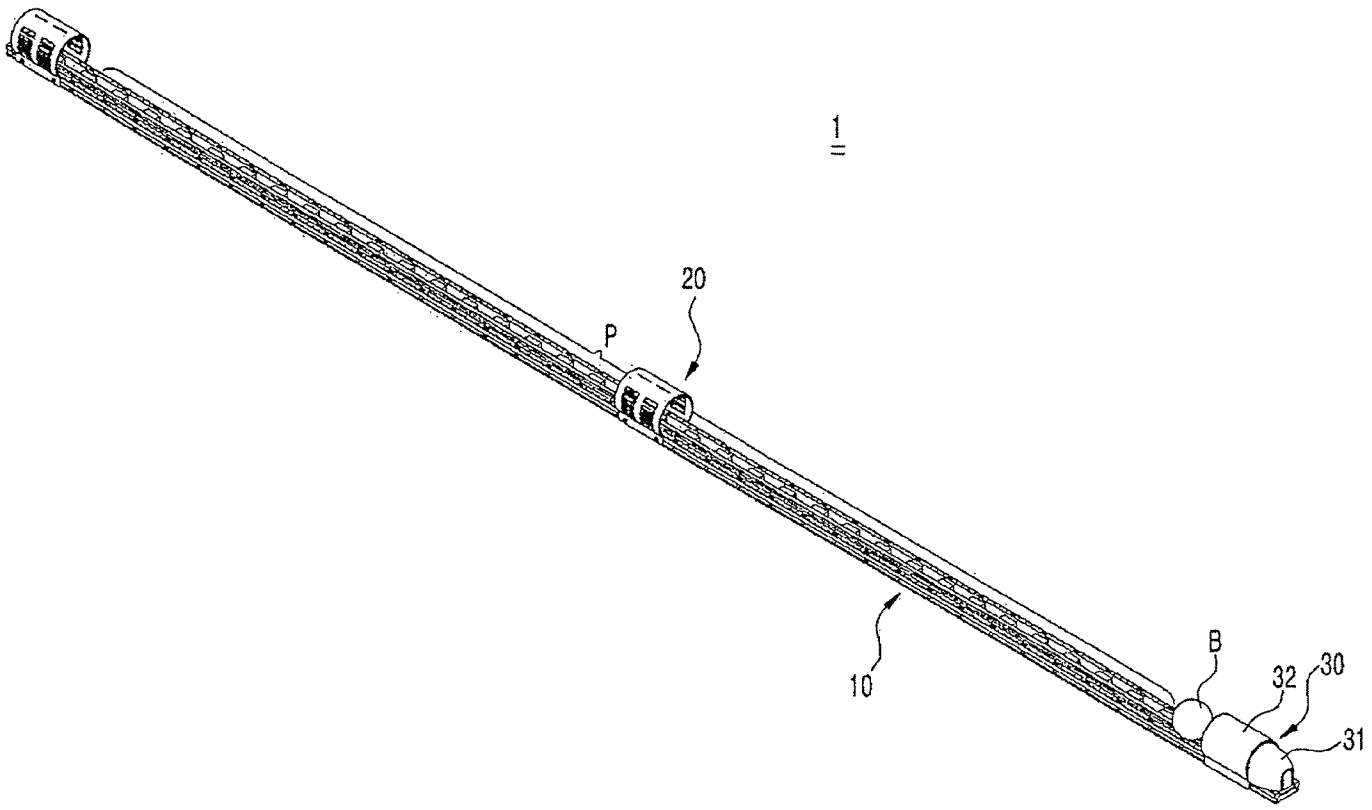
FIG. 1 is a perspective view showing a golf putting correction device, according to an embodiment of the present disclosure.
Figure 2:
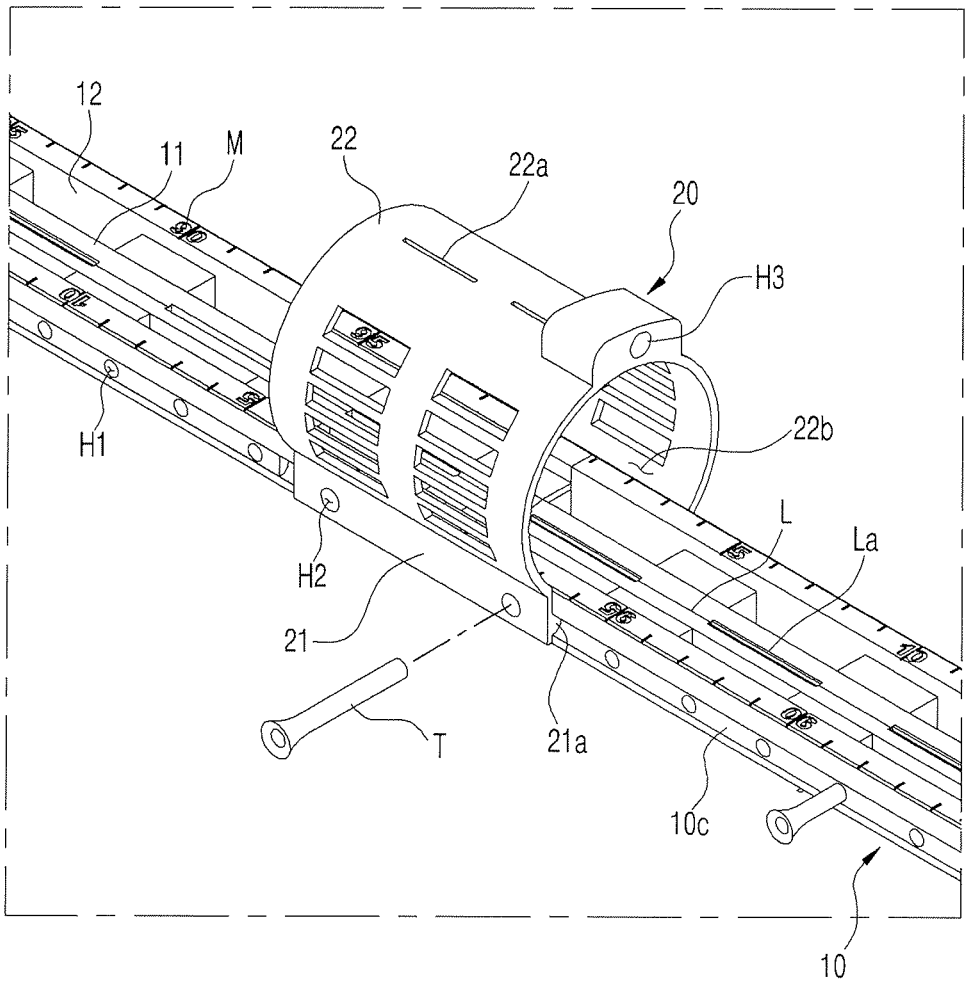
FIG. 2 is a partially enlarged view showing a body and a guide of the golf putting correction device of FIG. 1.
Figure 3A:
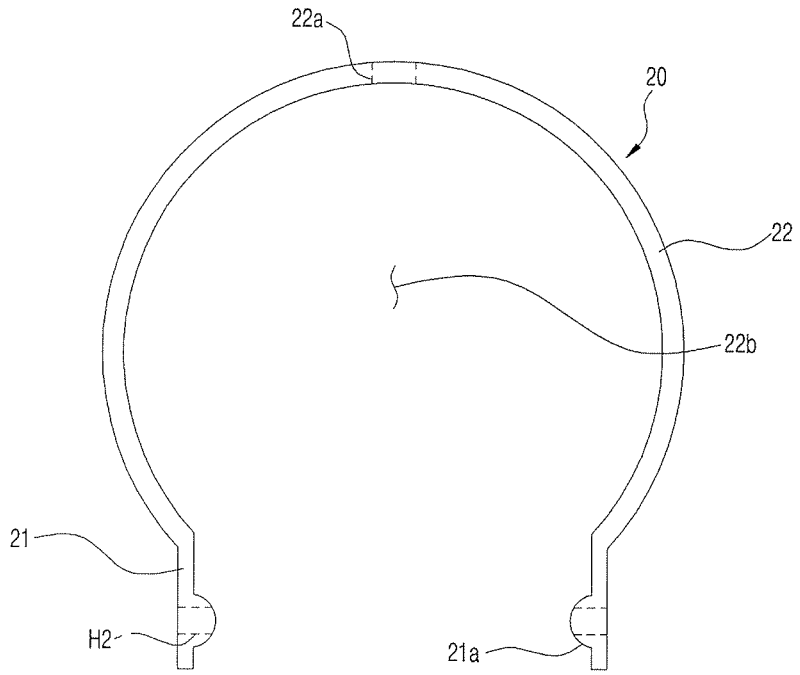
FIGS. 3A and 3B are cross-sectional views showing a body and a guide of the golf putting correction device of FIG. 1.
Figure 3A:
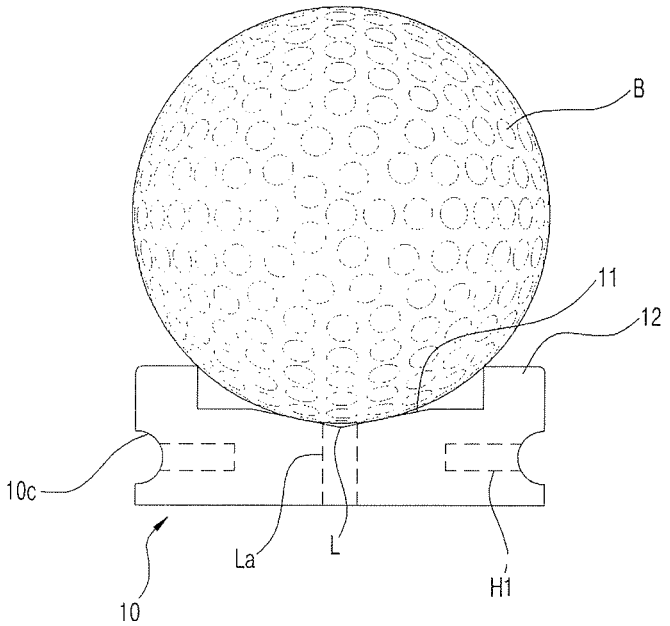
Figure 3B:
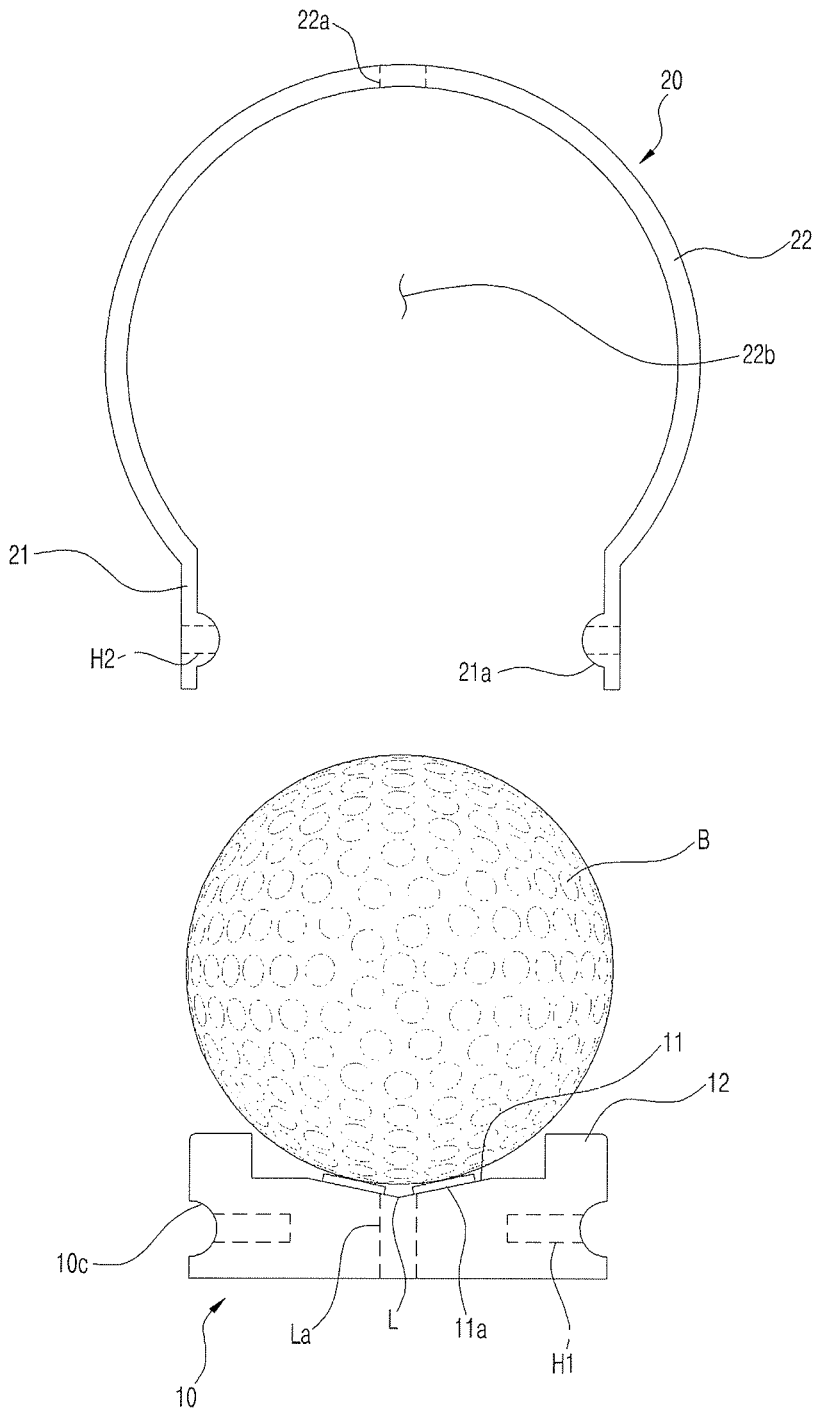
Figure 4A:
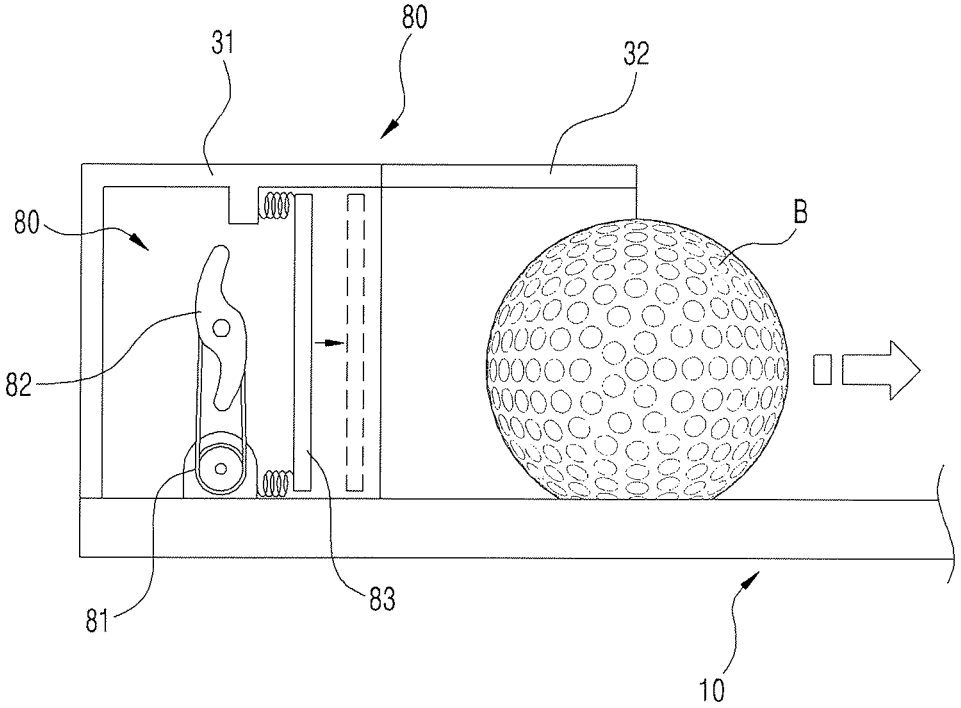
FIG. 4A is a cross-sectional view showing a target unit and a blow unit of a golf putting correction device, according to another embodiment of the present disclosure.
Figure 4B:
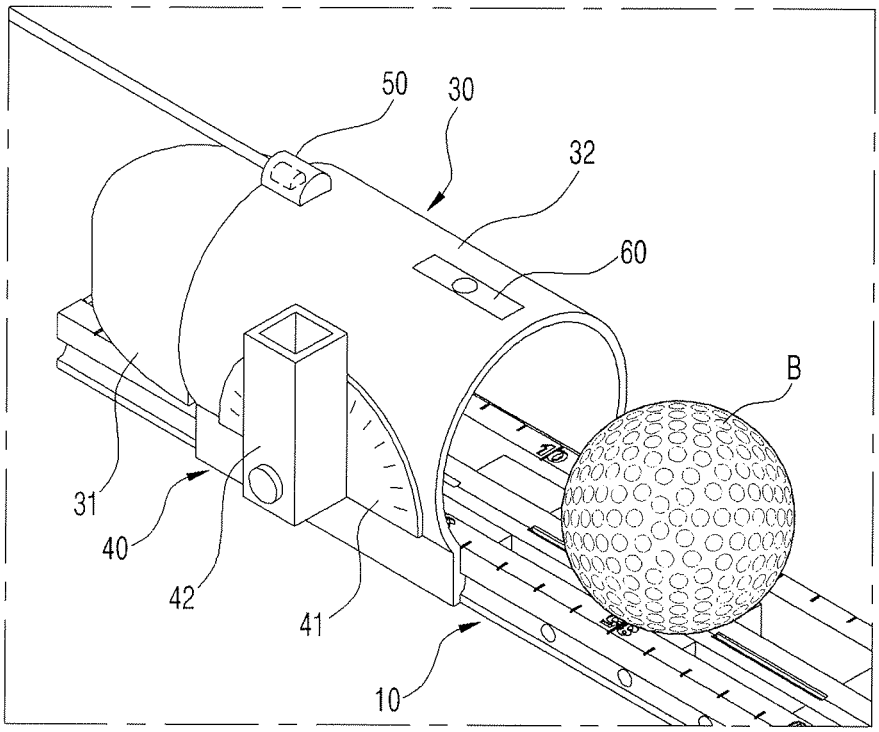
FIG. 4B is a partially enlarged view showing a target unit, a swing correction unit, a laser unit, and a level of a golf putting correction device, according to another embodiment of the present disclosure.
Figure 5:
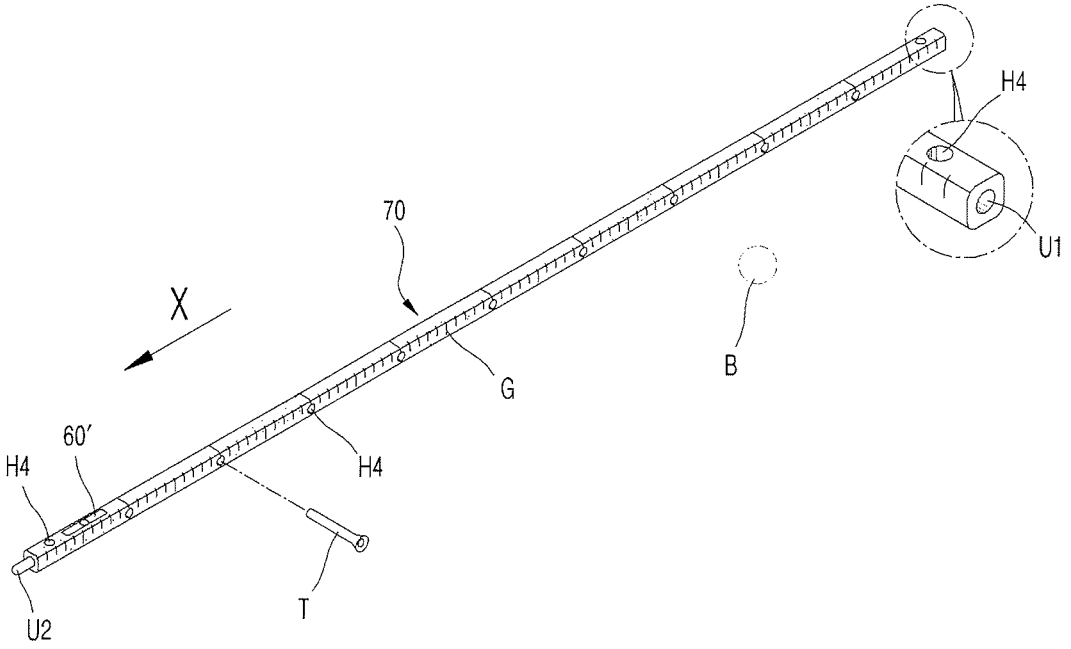
FIG. 5 is a view showing a golf practice stick of a golf putting correction device, according to another embodiment of the present disclosure.
Figure 6:
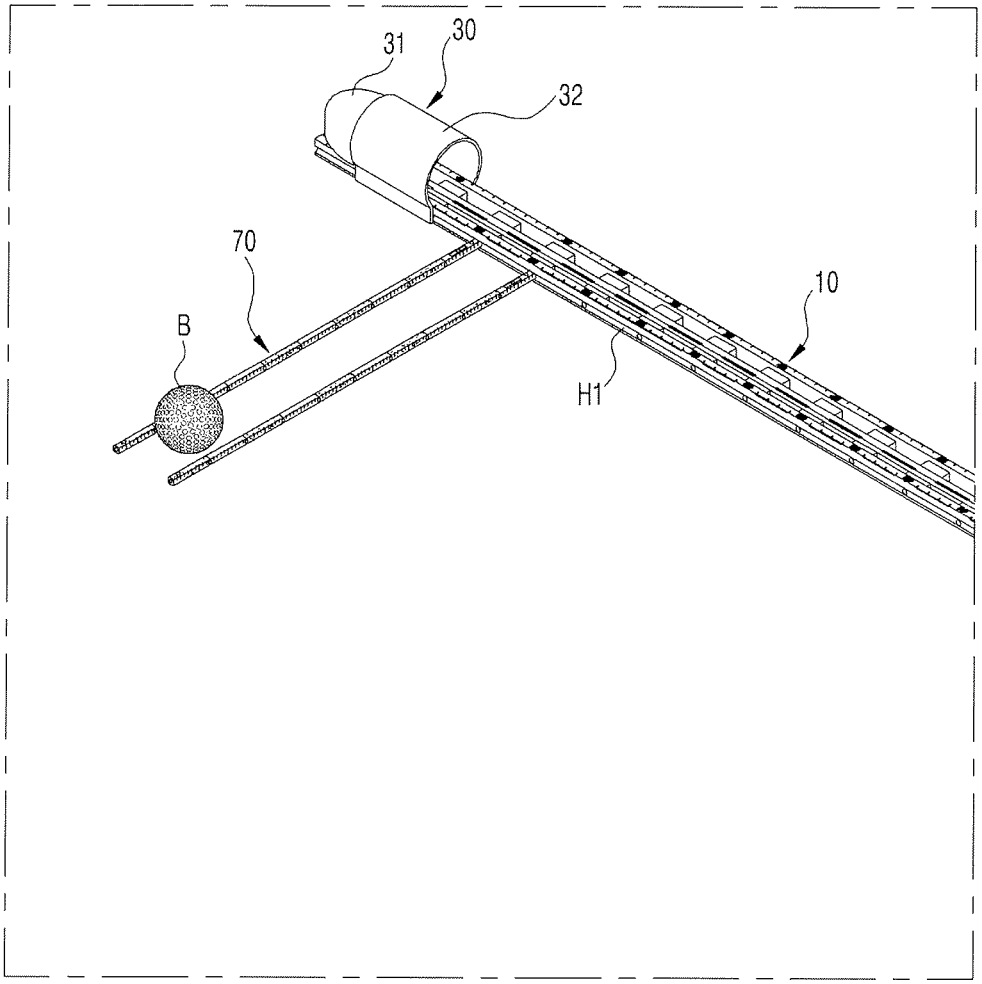
FIG. 6 is a view showing a state in which the golf practice stick is coupled to the golf putting correction device of FIG. 5.

FIG. 1 is a perspective view showing a golf putting correction device, according to an embodiment of the present disclosure, and FIG. 2 is a partially enlarged view showing a body and a guide of the golf putting correction device of FIG. 1. FIGS. 3A and 3B are cross-sectional views showing a body and a guide of the golf putting correction device of FIG. 1, and FIG. 4A is a cross-sectional view showing a target unit and a blow unit of a golf putting correction device, according to another embodiment of the present disclosure. FIG. 4B is a partially enlarged view showing a target unit, a swing correction unit, a laser unit, and a level of a golf putting correction device, according to another embodiment of the present disclosure, and FIG. 5 is a view showing a golf practice stick of a golf putting correction device, according to another embodiment of the present disclosure. In addition, FIG. 6 is a view showing a state in which the golf practice stick is coupled to the golf putting correction device of FIG. 5.

As shown in FIG. 1, a golf putting correction device 1, according to an embodiment of the present disclosure, is configured to naturally learn the accurate address, alignment, and position of a ball in the course of repeatedly practicing golf putting in order to thereby correct a putting posture, and includes a body 10, a guide 20, and a target unit 30.

As shown in FIGS. 1 and 2, the body 10 is formed long in one direction so as to form a straight runway (P) on which a golf ball (B) rolls, wherein the body 10 is formed in an approximate "U" shape while the upper side thereof is opened to form the straight runway (P) on which the golf ball (B) rolls. A marked line (L) is formed along the center of the straight runway (P).

The marked line (L) is intended to identify the progressing path of the golf ball (B) with the naked eye when putting, and may be formed to be painted in a different color from the surrounding, or may be formed by attaching a tape of a different color from the inside of the body 10. Alternatively, as shown in FIG. 2, the marked line (L) may be formed in the form of holes (La) that pass through the straight runway (P) along the center thereof in the body 10.

As shown in FIGS. 2 and 3A, the body 10 includes main rails 11 and deviation-preventing rails 12.

The main rails 11 are configured such that the golf ball (B) rests and rolls thereon, and are formed on both sides of the marked line (L), respectively. A pair of main rails 11 are formed to be symmetrically inclined toward the center of the golf ball (B) such that the golf ball (B) does not deviate from the main rails 11 when the golf ball (B) is hit by a putter while resting thereon. Preferably, the inclination angle of the main rail 11 is configured such that a normal line from the surface of the main rail 11 at the contact point with the resting golf ball (B) extends to the center of the golf ball (B).

The deviation-preventing rails 12 are intended to prevent the deviation of the golf ball (B), and are formed on both sides of the marked line (L) and on the outside of the main rails 11, respectively. The deviation-preventing rails 12 are formed to protrude upwards, respectively.

A pair of deviation-preventing rails 12 come into contact with both sides of the golf ball (B) in the state in which the golf ball (B) rests on the main rails 11, and prevent the golf ball (B) from rolling slantly in the direction other than the marked line (L).

As shown in FIG. 3B, a pair of rail members 11*a* may be formed on the main rails 11.

The rail member 11*a* is formed in a long bar that is coupled to the main rail 11. The rail members 11*a* are preferably formed in a different color from the inside of the body 10, and at this time, the marked line (L) may be extended to the central portion of the main rails 11, the central portion being separated by colors from the pair of main rails 11.

Although the rail member 11*a* is made of a hard material that has a small surface-abrasion even with the friction caused by the repeated rolling of the golf ball (B), it may be formed of a resilient material, such as rubber or silicon. The rail member 11*a* is a consumable object, and is bonded to the inclined surface of the main rail 11 by means of an adhesive portion formed on the bottom surface thereof. If a contact surface is worn out, it may be replaced with a spare rail member 11*a*.

When the rail members 11*a* are coupled to the main rails 11, the height of the golf ball (B) resting on the rail members 11*a* increases so that the golf ball (B) is spaced apart from the deviation-preventing rails 12.

Therefore, when the golf ball (B) is struck in the state in which the swing direction of the putter is not parallel with the direction of the marked line (L), the golf ball (B) will deviate from the rail members 11*a* to bump against the deviation-preventing rails 12 and to wobble. Thus, the practicer may visually identify the same, and may promptly recognize the incorrect swing direction of the putter in order to thereby correct the same.

The swing direction and the stroke force of a putter by which the golf ball (B) deviates from the rail members 11*a* may vary with the inclination angle of the main rails 11, and the inclination angle of the main rails 11 may be adjusted when manufacturing the same.

Referring to FIG. 1, the body 10 is formed to have an approximately similar length as a golf club, and its cross-section is configured to have a width of less than double the size of the golf ball (B). Therefore, the practicer may put the body 10 into the golf bag together with golf clubs. Thus, since the storage and transport thereof are convenient, the practicer can use the golf putting correction device any time and at any place, such as home, office, a golf driving range, or a golf course.

Although it is not shown in the drawings, Velcro tape may be attached to a lower portion of the golf bag and an end portion of the body to correspond to each other in order to practice putting while preventing the shaking, moving, and falling by the golf bag.

As shown in FIGS. 1 and 2, a guide 20 is formed above the straight runway (P) such that a portion of the marked line (L) is viewed only in a specific range of angle, and to include supports 21 and a cover portion 22.

A pair of supports 21 are coupled to both sides of the body 10 to be movable along the straight runway (P) of the body 10. Preferably, a slide projection 21*a* is formed on the support 21, and a slide groove 10*c* is formed on the body 10 along the longitudinal direction thereof so that the guide 20 is coupled to the body 10 to be slidable.

As shown in FIGS. 2 and 3A, the cover portion 22 connects the upper ends of the supports 21 to each other, and has through-holes 22*a* formed to correspond to the marked line (L). The through-hole 22*a* is formed in a narrow and elongated slit, and preferably, is formed in the vertical position from the marked line (L) such that the practicer's eyes and the marked line (L) are aligned in a straight line. The cover portion includes a passage 22*b* formed to allow the golf ball (B) to pass through the same.

The golf putting correction device 1 of the present disclosure is configured to allow the practicer to practice putting while viewing the marked line (L) through the through-hole 22*a*, and this is intended to correct the address posture. The eyes, hole, and golf ball (B) are required to be positioned on the same line in the correct address posture. Otherwise, a push or pull phenomenon may occur during the putting.

When the practicer places the golf ball (B) on a pair of main rails 11 and practices putting while viewing the marked line (L) through the through-hole 22*a*, since the through-hole 22*a* is formed in the vertical position from the marked line (L), the putting practice can be made in the state in which the practicer's eyes, the marked line (L), and the golf ball (B) are positioned on the same line.

Therefore, the practicer who repeatedly practices putting by using the golf putting correction device 1 of the present disclosure may naturally learn the address posture in which the stroke is made in the state in which the eyes, hole, and golf ball (B) are positioned on the same line As shown in FIG. 2, a tee insertion groove (H3) into which a golf tee (T) is inserted may be formed on the cover portion 22 in a straight line with the through-hole 22*a*. The tee insertion groove (H3) may be formed in the vertical direction or in the horizontal direction on a straight line with the through-hole 22*a*, and the practicer may practice putting in the state in which a golf tee (T) inserted into the tee insertion groove (H3) is viewed in a straight line with the marked line (L), instead of the through-hole 22*a*.

As shown in FIG. 2, tee insertion holes (H1) into which a golf tee (T) is inserted, as well as gradations (M), are formed in the body 10 along the longitudinal direction of the straight runway (P).

If the gradations (M) and the tee insertion holes (H1) are formed on the body 10, the practicer may identify or display the foot position in the correct address posture together with the position of the golf ball (B) through the gradations (M) and the golf tee (T). According to this, since the eyes, golf ball (B), and hole may be aligned in a straight line and the feet may be arranged in a correct position and at a correct interval, the putting practice can be repeatedly made while maintaining a correct address posture.

Referring to FIG. 1, the target unit 30 is configured to play the role of a target point of a golf ball during the putting practice and is configured to stop the rolling golf ball. The target unit 30 includes a blocker 31 and a target member 32.

The blocker 31 is coupled to one end of the body, and is intended to stop the rolling golf ball by bumping into the same.

The target member 32 is configured to play the role of a target point for putting the golf ball, which forms a passage through which a golf ball passes and is coupled to the body to be slidable along the straight runway. The target member 32 functions as a putting target point of a golf ball or a hole cup in the position near the blocker 31 or between the stroke position of the golf ball and the blocker 31.

As shown in FIG. 4A, the blocker 31 may be provided with a blow unit 80 that returns, to the other end of the body, a golf ball that has rolled in during the putting practice.

The blow unit 80 is intended to return, to the practicer, a golf ball (B) that has rolled in during the putting practice, and includes a motor 81, a battery (not shown), a controller (not shown), a blow wing 82, and a blow plate 83.

The controller is configured to control the rotation of the motor 81, and is configured to supply electric power of the battery to the motor 81 in a predetermined period. For example, the controller may be configured to supply electric power, for a constant time, to the motor 81 every ten seconds.

The blow wing 82 is coupled to the blocker 31 to be rotatable by means of the motor 81. Two or more blow wings 82 are provided to be rotated about a central shaft (that receives a rotational force by means of the motor 81 and a belt, a chain, or a gear) in order to thereby strike the blow plate 83.

The blow plate 83 is connected to the blocker 31 by means of an elastic member so as to reciprocate within a predetermined distance. The blow plate 83 is struck by the blow wing 82 to reciprocate and to strike the golf ball (B) to roll to the other end of the body 10 again by passing through the target member 32.

The main rails 11 are preferably formed to be inclined downwards by a predetermined distance toward the blow plate 83 such that the golf ball (B) that has rolled to the blow unit 80 may be positioned at a place where the blow plate 83 is able to strike the golf ball (B).

As shown in FIG. 4B, the body 10 or the target unit 30 includes a laser unit 50 that emits a laser in parallel with the straight runway (P). The laser unit 50 is installed at the end of the body 10 or in the target unit 30 that is provided at the end of the body 10 on the opposite side of the golf ball (B) that rests on the main rails 11 from the guide 20 in order to allow the practicer to view the same together with the marked line (L) during the putting practice.

When the laser unit 50 emits a laser in parallel with the straight runway (P) from the golf putting correction device 1, the laser beam may be observed on the extended line of the marked line (L). Thus, the practicer may accurately recognize the alignment direction of the marked line (L), and may practice a long-putting while regarding the laser beam incident on a wall, a tree, or an object as a virtual hole.

As shown in FIG. 4B, a swing correction unit 40 is configured to correct the rotational angle of a golf club when putting, and is provided on the side of the body 10. The swing correction unit 40 includes a goniometer 41 and an angle indication rod 42.

The goniometer 41 is provided on the side of the body 10 such that it displays the ground surface in the range of 0 degrees to 180 degrees while a point of 90 degrees is directed upwards.

The angle indication rod 42 is coupled to the central axis of the goniometer 41 to be rotatable. When the swing practice of putting is made in the state in which the angle indication rod 42 is rotated at a desired swing angle of the golf club, the swing angle of the golf club of the putting may be corrected through the comparison to the swing angle of the golf club.

The angle indication rod 42 may be formed in the form of a pipe having an opening at one end thereof in order to insert a golf practice stick 70 or an object in a sick shape, which will be described later, into the same in the longitudinal direction thereof. When a swing practice is performed in the state in which the golf practice stick 70 is inserted into the end of the angle indication rod 42, since the golf practice stick 70 is positioned on the extended line of the angle indication rod 42, it is easy to compare the swing angle of the golf club.

As shown in FIG. 4B, a level 60 is provided in the body 10 or in the target unit 30 to measure the horizontality of the floor.

The inclination of the ground surface is directly related to the rolling distance and direction of the golf ball (B) when putting, and the golf putting correction device 1 of the present disclosure displays the horizontality of the floor in order to thereby enable an accurate putting practice. That is, since the practicer may identify the inclination of the floor on which the golf putting correction device 1 is placed by checking the level 60 when putting, it is possible to perform the putting practice in consideration of the inclination.

As shown in FIGS. 5 and 6, the golf putting correction device 1 may be configured to further include a golf practice stick 70.

The golf practice stick 70 is configured to easily perform the set-up posture correction, the setting of the ball position, the swing trajectory correction, and the putting practice during the golf swing practice, and is formed long in one direction to have a rectangular cross-section. Since the golf practice stick 70 is formed in a long stick shape having a rectangular cross-section, it is prevented from rolling when it is placed on an inclined floor or when it is hit by the rolling golf ball (B).

A protrusion U2 that is inserted into the tee insertion hole (H1) and a coupling groove U1 into which the protrusion U2 is inserted to be coupled may be formed at both ends of the golf practice stick 70, respectively, such that the golf practice stick 70 is inserted into the tee insertion hole (H1) of the body 10 for use, or two or more golf practice sticks 70 are coupled to each other. Of course, the golf practice stick 70 may also be used separately on the floor without being coupled to the golf putting correction device 1.

In addition, tee insertion holes (H4) into which golf tee (T) is inserted may be formed on the golf practice stick 70 along the longitudinal direction thereof. Thus, it is easy to identify the position of feet, golf ball (B), or duff by simply inserting the golf tee (T) into the tee insertion hole (H4). Even if the golf tee (T) is struck during the swing, since the damage is concentrated on the consumable golf tee (T), the golf practice stick 70 can be used for a long time.

In addition, the golf practice stick 70 has gradations (G) formed along the longitudinal direction thereof to identify the moving distance of the golf club head and the rolling distance of the golf ball (B). When putting, the distance of a back stroke or a forward stroke is directly related to the rolling distance of the golf ball (B). Since the golf practice stick 70 includes the gradations (G) formed along the longitudinal direction, the practicer may accurately identify the distance of a back stroke or a forward stroke.

Two or more sections in different colors may be repeatedly formed in the golf practice stick 70 along the longitudinal direction thereof in order to identify the moving distance of the golf club head and the rolling distance of the golf ball (B) by colors, and thus, the practicer may visually recognize the rolling distance of the golf ball (B) within a small error range during the putting practice.

As shown in FIG. 6, the golf putting correction device 1 has an advantage in that the swing practice and the putting practice can be simultaneously performed by coupling the golf practice stick 70 to the body 10.

According to the present disclosure, it is possible to provide a golf putting correction device 1 that includes: a body 10 formed long in one direction so as to form a straight runway (P) on which a golf ball (B) rolls, and having a marked line (L) formed along the center of the straight runway (P); and a guide 20 formed above the straight runway (P), and having a through-hole 22*a* formed to be parallel with the marked line (L), and that can: correct a putting posture by practicing putting while observing the marked line (L) through the through-hole 22*a*; correct an address posture such that eyes, a hole, and a golf ball (B) are aligned on the same line; maintain the progressing direction of the golf ball (B) to be constant even if it is repeatedly used; and provide a convenient transport and storage.

In addition, it is possible to provide a golf putting correction device 1 that can easily correct a leg interval and the positions of the feet and ball by forming tee insertion holes (H1), into which a golf tee (T) is inserted, and gradations (M) on the body 10 along the longitudinal direction of the straight runway (P).

In addition, it is possible to provide a golf putting correction device 1 that can automatically collect golf balls (B) when putting by providing one end of the body 10 with a blow unit 80 that returns, to the other end of the body, the golf ball (B) that has rolled in during the putting practice Furthermore, it is possible to provide a golf putting correction device 1 that allows the practicer to visually identify whether or not the golf ball (B) is hit by the putter at a sweet spot by means of the body 10 that includes: a pair of main rails 11 that are formed on both sides of the marked line (L) such that the golf ball (B) rests and rolls thereon; and a pair of deviation-preventing rails 12 that are formed on both sides of the marked line (L) and on the outside of the main rails 11 so as to be spaced apart from the golf ball (B).

Although the specific embodiment of the present disclosure has been described above, it is apparent to those skilled in the art that the present disclosure is not limited to the embodiment disclosed herein and various modifications and changes can be made without departing from the spirit and scope of the present disclosure. Therefore, such modifications and changes should not be individually construed from the spirit or point of view of the present disclosure, and it should be understood that modified embodiments belong to the claims of the present disclosure.

The golf putting correction device, according to the present disclosure, includes: a body that is formed long in one direction so as to form a straight runway on which the golf ball rolls and is configured to have a marked line formed along the center of the straight runway; and a guide that is formed above the straight runway and is configured to have through-hole formed to be parallel with the marked line, and may: correct a putting posture through a putting practice while observing the marked line through the through-hole; correct an address posture such that eyes, a hole, and a golf ball are aligned on the same line; maintain the progressing direction of the golf ball to be constant even if it is repeatedly used; and provide a convenient transport and storage. For this reason, the present disclosure may: overcome the limits of existing technologies; have sufficient potential for selling application devices or doing business thereof, as well as utilizing the related art; and be explicitly executed in reality, so that the present disclosure has industrial applicability.

What is claimed is:

1. A golf putting correction device for use with a golf ball comprising:

a body formed long in one direction so as to form a straight runway on which the golf ball rolls, and having a marked line formed along a center of the straight runway; and a guide formed above the straight runway and coupled thereto, the guide having a through-hole formed to be parallel with the marked line, wherein a putting posture is corrected by a putting practice while observing the marked line through the through-hole;

wherein the guide comprises:

a pair of supports coupled to the body to be slidable along the straight runway; and a cover portion configured to connect the pair of supports to each other, and having the through-hole formed therein, wherein a passage through which a golf ball passes is formed in the cover portion.

2. The golf putting correction device according to claim 1, wherein a target unit configured to stop a rolling golf ball during the putting practice is installed at one end of the body.

3. The golf putting correction device according to claim 2, wherein the target unit comprises:

a blocker coupled to one end of the body such that a rolling golf ball bumps into the same; and a target member coupled to the body to be slidable along the straight runway, and having a passage formed to allow a golf ball to pass through the same.

4. The golf putting correction device according to claim 3, wherein the blocker includes a blow unit configured to return, to the other end of the body, a golf ball that has rolled in during the putting practice.

5. The golf putting correction device according to claim 4, wherein the blow unit comprises:

a blow wing configured to rotate while interworking with a motor; and a blow plate configured to be pushed toward the other end of the body when being struck by the blow wing.

6. The golf putting correction device according to claim 1, wherein a swing correction unit is installed on the side of the body, which includes a goniometer and an angle indication rod coupled to a central axis of the goniometer to be rotatable about a horizontal axis.

7. The golf putting correction device according to claim 1, wherein tee insertion holes into which a golf tee is inserted are formed on the body along the longitudinal direction of the straight runway.

8. The golf putting correction device according to claim 1, wherein the body includes a laser unit configured to emit a laser in parallel with the straight runway.

9. The golf putting correction device according to claim 1, wherein the body includes gradations formed along the longitudinal direction of the straight runway.

10. The golf putting correction device according to claim 1, wherein the body includes: a pair of main rails formed on both sides of the marked line such that the golf ball rests and rolls thereon; and a pair of deviation-preventing rails formed on both sides of the marked line and on the outside of the main rails.

11. The golf putting correction device according to claim 10, wherein the pair of main rails are symmetrically inclined toward a center of the golf ball.

12. A golf putting correction device for use with a golf ball comprising:

a body formed long in one direction so as to form a straight runway on which the golf ball rolls, and having a marked line formed along a center of the straight runway; and a guide formed above the straight runway and having a through-hole formed to be parallel with the marked line, wherein a putting posture is corrected by a putting practice while observing the marked line through the through-hole, wherein the guide comprises:

a pair of supports coupled to the body to be slidable along the straight runway; and a cover portion configured to connect the pair of supports to each other, and having the through-hole formed therein, wherein a passage through which a golf ball passes is formed in the cover portion.

13. The golf putting correction device according to claim 12, wherein a tee insertion groove into which a golf tee is inserted in a straight line with the through-hole is formed in the cover portion.

14. A golf putting correction device for use with a golf ball comprising:

a body formed long in one direction so as to form a straight runway on which the golf ball rolls, and having a marked line formed along a center of the straight runway;

a guide formed above the straight runway and having a through-hole formed to be parallel with the marked line, wherein a putting posture is corrected by a putting practice while observing the marked line through the through-hole; and a golf practice stick configured to be: detachably coupled to the body; formed long in an X-direction; and formed to have a rectangular cross-section so as not to roll in the direction perpendicular to the X-direction even when it is placed on the inclined floor, wherein a protrusion configured to be inserted into a tee insertion hole and a coupling groove into which the protrusion is inserted are formed at both ends of the golf practice stick, respectively.

* * * * *